United States Patent [19]

Knapp, Jr.

[11] 3,962,668

[45] June 8, 1976

[54] ELECTRIC LOW-VOLTAGE FUSE

[75] Inventor: Edward J. Knapp, Jr., Merrimac, Mass.

[73] Assignee: The Chase-Shawmut Company, Newburyport, Mass.

[22] Filed: Apr. 22, 1975

[21] Appl. No.: 570,366

[52] U.S. Cl. ..... 337/228; 337/186; 337/231

[51] Int. Cl.[2] ..... H01H 85/14

[58] Field of Search ..... 337/159, 166, 186, 205, 337/228, 246, 252, 273, 248; 338/332

[56] References Cited

UNITED STATES PATENTS

| | | | |
|---|---|---|---|
| 2,782,286 | 2/1957 | Detch | 337/248 X |
| 3,029,328 | 4/1962 | Kozacka | 337/166 X |
| 3,374,330 | 3/1968 | Cameron | 337/248 X |
| 3,460,086 | 8/1969 | Rister | 337/246 X |

*Primary Examiner*—J D Miller
*Assistant Examiner*—Fred E. Bell
*Attorney, Agent, or Firm*—Erwin Salzer

[57] ABSTRACT

A miniature fuse for small current ratings and small voltage ratings has a casing of porous cellulosic material, a pulverulent non-fulgurite-forming arc-quenching filler, a fusible element of low fusing point metal having ends bent upon the outer surface of the casing and squashed by the pressure of terminal caps press-fitted on the casing, and bodies of a cured synthetic resin imparting dimensional stability to the ends of the casing, firmly affixing the terminal caps to the casing, and resulting in the formation of a conductively stable mechanical connection between the fusible element and the terminal caps.

3 Claims, 2 Drawing Figures

ELECTRIC LOW-VOLTAGE FUSE

BACKGROUND OF THE INVENTION

This invention relates to electric fuses having a small current rating and voltage rating, being of small size and that lend themselves to be manufactured at relatively small cost. One object of the invention is to provide fuses of the above description having casings of cellulosic material, or paper board. Casings of such material have a very small dimensional stability. For this reason it is difficult to firmly mount terminal caps on casings of cellulosic material, and to establish reliable conductive connections between the terminal caps and the ends of the fusible element which is arranged inside of the casing. The present invention overcomes these difficulties and provides fuses of the aforementioned description wherein a mechanical contact results in effective conductive connections between the terminal caps and the fusible element.

SUMMARY OF THE INVENTION

Fuses embodying this invention include a tubular casing of absorbent cellulosic material. There is a pulverulent non-fulgurite-forming arc-quenching filler inside the casing. A fusible element of soft low fusing point metal is arranged inside said casing, embedded in said filler and has ends bent around the rims formed by said casing at the ends thereof into engagement with the other surface of said casing. Fuses embodying this invention further include a pair of terminal caps each mounted under pressure on one of said ends of said casing, reducing the thickness and flattening said ends of said fusible element in engagement with said outer surface of said casing to form connector tabs having a width larger than the width of other portions of said fusible element. Fuses embodying this invention further include two bodies of a cured synthetic resin inside said casing adjacent said ends thereof. A portion of said resin forming each of said bodies is absorbed by said ends of said casing and thereby hardens and stiffens said ends. Each of said pair of terminal caps is adhesively bonded by said resin to one of said hardened and stiffened ends of said casing.

DESCRIPTION OF PREFERRED EMBODIMENT

Figure 1:
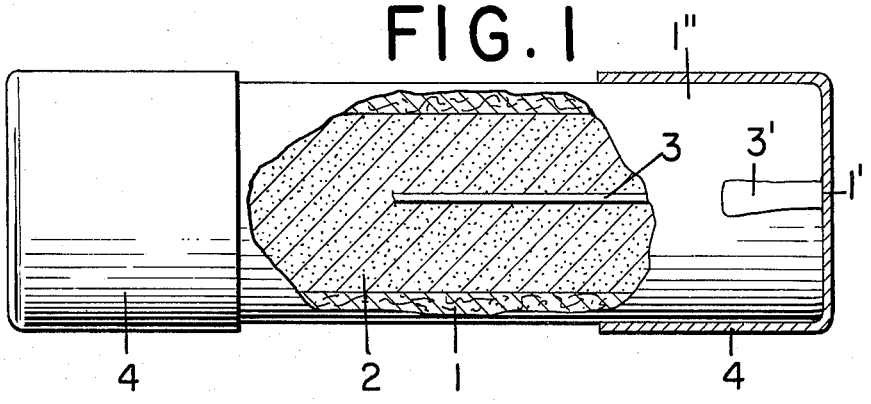
FIG. 1 is in part a side elevation and in part a longitudinal section of a fuse embodying this invention showing such a fuse on a larger scale than its actual size.

Referring now to the drawings, numeral 1 has been applied to indicate a tubular casing of absorbent cellulosic material. It contains a pulverulent non-fulgurite-forming arc-quenching filler 2, preferably gypsum powder. A fulgurite-forming arc-quenching filler such as quartz sand is not applicable under the contemplated circumstances. A fusible element 3 of a soft low fusing point metal, e.g. lead, preferably in form of a wire whose cross-section is round, is arranged inside of casing 1 and embedded in filler 2. In FIG. 1 the left end of fusible element 3 is broken away and in FIG. 2 only the ends of fusible element 3 are shown in section while its intermediate portion has been shown in elevation. Fusible element 3 has ends 3' bent around the rims 1' formed by casing 1 at the ends thereof into engagement with the outer surface 1'' of casing 1. Reference numeral 4 has been applied to indicate a pair of terminal caps, preferably of a non-ferrous material and silver plated. Terminal caps 4 are mounted under pressure, or press-fitted on the ends of casing 1. The ends 3' of fusible element 3 on the outer surface 1'' of casing 1 are reduced in thickness and flattened and form connector tabs having a width larger than the width of other portions of fusible element 3. Reference numeral 5 has been applied to indicate two bodies of a synthetic resin, preferably of an epoxy resin, arranged inside of casing 1 adjacent the ends thereof. A portion of the resin forming bodies 5 is absorbed by the axially outer ends of casing 1 and thereby hardens and stiffens said ends following curing of the resin. Each of the pair of terminal caps 4 is adhesively bonded by the resin of which bodies 5 consist to the ends of casing 1 that are hardened and stiffened by it.

The process of manufacturing fuses as disclosed above includes the steps of dropping some synthetic resin into each of terminal caps 4, wetting the lateral surfaces of the caps 4 on the inside of the latter with resin and then mounting caps 4 under pressure upon the axially outer ends of casing 1. This results in absorption of resin by the ends of casing 1, imparting considerable dimensional stability to the ends thereof. The bodies 5 of synthetic resin are adhesively bonded to the inner surface of the casing 1 and to the axially inner end surfaces of terminal caps 4 and thus form a strong tie between parts 1 and 4. In addition thereto the lateral inner surfaces of caps 4 are adhesively bonded to the outer surface 1'' of casing 1 adjacent the ends thereof. The flattened ends 3' of fusible element 3 outside of casing 1 are not covered by synthetic resin. The radially inner surfaces of flattened ends or tabs 3' are pressed into, and thus recessed within, the outer surface of casing 1. Due to the pressure prevailing between the radially outer surfaces of tabs 3' and the lateral walls of caps 4 on the inside thereof all synthetic resin is squeezed away from the interfaces between tabs 3' and the inner lateral walls of caps 4. Since the tabs 3' are of a relatively soft metal and caps 4 are of a relatively hard metal, a direct metallic highly conductive connection is established between parts 3' and 4.

Figure 2:
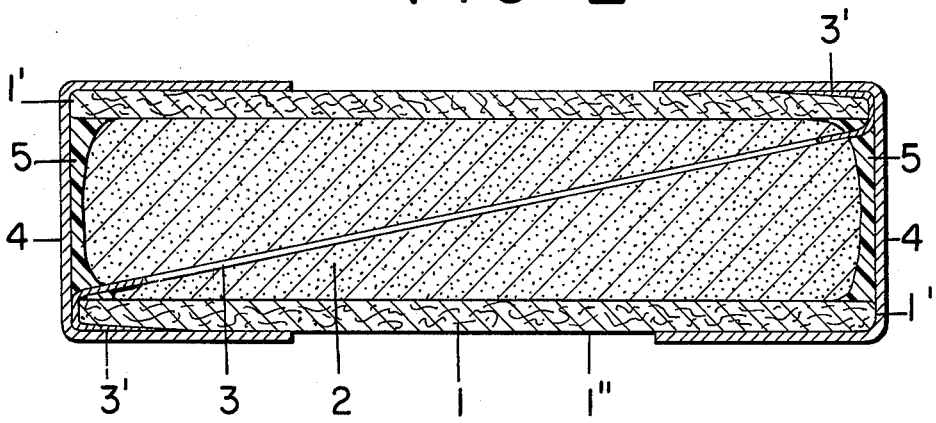
FIG. 2 is a longitudinal section of the same structure as that shown in FIG. 1 sectioned along a plane at right angles to the plane resulting in the section shown in FIG. 1.

Upon removal of caps 4 from the complete assembly shown in FIGS. 1 and 2 for purposes of investigation deposits or particles of the soft metal of which fusible element 3 consists may readily be discovered on the insides of the lateral surfaces of caps 4.

I claim as my invention:

1. An electric fuse including a. a tubular casing of absorbent cellulosic material;

b. a pulverulent non-fulgurite-forming arc-quenching filler inside said casing;

c. a fusible element of a soft low fusing point metal inside said casing, embedded in said filler and having ends bent around the rims formed by said casing at the ends thereof into engagement with the outer surface of said casing;

d. a pair of terminal caps each mounted under pressure on one of said ends of said casing, reducing the thickness and flattening said ends of said fusible element in engagement with said outer surface of said casing to form connector tabs having a width larger than the width of other portions of said fusible element; and e. two bodies of a cured synthetic resin inside said casing adjacent said ends thereof, a portion of said resin forming each of said bodies being absorbed by said ends of said casing and thereby hardening and stiffening said ends, and each of said pair of terminal caps being adhesively bonded by said resin to one of said hardened and stiffened ends of said casing.

2. A fuse as specified in claim 1 wherein said two bodies are formed by a resin pertaining to the epoxy family of resins.

3. A fuse as specified in claim 1 wherein the portion of said fusible element inside said casing is in the form of a wire having a round cross-section, the portions of said fusible element on the outer surface of said casing have a width considerably in excess of the diameter of said cross-section and wherein said pulverulent arc-quenching filler is gypsum powder.

* * * * *